US012497147B2

(12) United States Patent
Johansson et al.

(10) Patent No.: US 12,497,147 B2
(45) Date of Patent: Dec. 16, 2025

(54) ANGULARLY POSITIONED MARINE PROPELLER COMBINATION AND A METHOD OF OPERATING A MARINE PROPELLER COMBINATION

(71) Applicant: VOLVO PENTA CORPORATION, Gothenburg (SE)

(72) Inventors: Lars Johansson, Sävedalen (SE); Johan Tell, Gothenburg (SE); Peter Carlsson, Stenungsund (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 0 days.

(21) Appl. No.: 18/643,284

(22) Filed: Apr. 23, 2024

(65) Prior Publication Data

US 2024/0367769 A1 Nov. 7, 2024

(30) Foreign Application Priority Data

May 5, 2023 (EP) ..... 23171868

(51) Int. Cl.
*B63H 1/20* (2006.01)
*B63H 5/08* (2006.01)
(Continued)

(52) U.S. Cl.
CPC ..... *B63H 1/20* (2013.01); *B63H 5/08* (2013.01); *B63H 5/10* (2013.01); *B63H 23/02* (2013.01); *B63H 2005/106* (2013.01)

(58) Field of Classification Search
CPC ..... B63H 5/10; B63H 1/20; B63H 2005/103; B63H 2005/106; B63H 23/02;
(Continued)

(56) References Cited

U.S. PATENT DOCUMENTS

RE34,011 E 7/1992 Brandt
7,223,074 B2 * 5/2007 Rydberg ..... B63H 23/34 416/198 R
(Continued)

FOREIGN PATENT DOCUMENTS

CN 202848014 U 4/2013
EP 1597144 A1 11/2005
(Continued)

OTHER PUBLICATIONS

Machine Translation of CN 202848014 U [retrieved on Dec. 30, 2024]. Retrieved from: Espacenet. (Year: 2024).*
(Continued)

*Primary Examiner* — Eric J Zamora Alvarez
(74) *Attorney, Agent, or Firm* — Jeffri A. Kaminski; Venable LLP

(57) ABSTRACT

A marine propeller combination for a marine propulsion unit includes a first propeller and a second propeller arranged to rotate simultaneously in opposite directions about a common rotational axis. The marine propeller combination is configured such that the first and second propellers are angularly positioned such that during one revolution one of the blades of the first propeller is aligned with a drive leg of the marine propulsion unit when a blade gap of the second propeller is aligned with the drive leg, or one of the blades of the first propeller is aligned with the drive leg when one of the blades of the second propeller is aligned with the drive leg. The disclosure further relates to a marine vessel and to a method of operating a marine propeller combination.

17 Claims, 2 Drawing Sheets

(51) Int. Cl.
*B63H 5/10* (2006.01)
*B63H 23/02* (2006.01)

(58) Field of Classification Search
CPC . B63H 23/34; B63H 5/08; B63H 1/14; B63H 1/26; B63H 20/00; F16D 2001/103; F16D 3/10; B63G 8/001; B63G 8/16; B64C 11/48; F05D 2230/64; F05D 2260/40311
See application file for complete search history.

(56) References Cited

U.S. PATENT DOCUMENTS

| | | | | |
|---|---|---|---|---|
| 9,022,738 | B1 | 5/2015 | Silberg et al. | |
| 10,494,070 | B2 | 12/2019 | McKinny, Jr. | |
| 10,569,851 | B1 | 2/2020 | DeJesus | |
| 11,339,860 | B1 | 5/2022 | Smith et al. | |
| 2006/0281376 | A1 | 12/2006 | Buzzi | |
| 2009/0304510 | A1* | 12/2009 | Duncan ..... | B63H 25/42 416/147 |

FOREIGN PATENT DOCUMENTS

| | | | |
|---|---|---|---|
| GB | 521868 | A | 6/1940 |
| WO | 2004074089 | A1 | 9/2004 |

OTHER PUBLICATIONS

Extended European Search Report in corresponding European Application No. 23171868.5 dated Nov. 2, 2023 (8 pages).

* cited by examiner

ANGULARLY POSITIONED MARINE PROPELLER COMBINATION AND A METHOD OF OPERATING A MARINE PROPELLER COMBINATION

TECHNICAL FIELD

The disclosure relates generally to marine propulsion. In particular aspects, the disclosure relates to a marine propeller combination for a marine propulsion unit, a marine propulsion unit, a marine vessel, and a method of operating a marine propeller combination. The disclosure can be applied to marine vessels, such as water crafts, motorboats, work boats, sport vessels, sailboats, boats, ships, among other vessel types. Although the disclosure may be described with respect to a particular vessel, the disclosure is not restricted to any particular vessel.

BACKGROUND

Marine propulsion units are used to propel marine vessels in water. Some marine propulsion units comprise one or more propellers. In some examples, two concentric propellers may be arranged to rotate in opposite directions. The latter solution brings a number of benefits, such as high efficiency and good acceleration.

SUMMARY

According to a first aspect of the disclosure, there is provided a marine propeller combination for a marine propulsion unit, the marine propeller combination comprising a first propeller and a second propeller arranged to rotate simultaneously in opposite directions about a common rotational axis. The marine propeller combination is configured such that the first and second propellers are angularly positioned such that during one revolution one of the blades of the first propeller is aligned with a drive leg of the marine propulsion unit when a blade gap of the second propeller is aligned with the drive leg, or one of the blades of the first propeller is aligned with the drive leg when one of the blades of the second propeller is aligned with the drive leg.

The first aspect of the disclosure may seek to optimise the operation of a marine propeller combination. A technical benefit may include higher efficiency and reduced vibrations and noise. Said benefits may also be valid should the marine propeller combination be used for power generation, i.e. for generating electric power from water that moves in relation to the marine propeller combination.

By the first and second propellers being angularly positioned may be meant that the first and second propellers are deliberately, consciously or purposively angularly positioned. I.e. that the respective angular position of the propellers with respect to the drive leg is not arbitrary, but is to the contrary deliberately set or selected.

Optionally in some examples, including in at least one preferred example, one of the blades of the first propeller is aligned with the drive leg when a blade gap of the second propeller is aligned with the drive leg in a forward drive configuration of the marine propeller combination.

Optionally in some examples, including in at least one preferred example, one of the blades of the first propeller is aligned with the drive leg when one of the blades of the second propeller is aligned with the drive leg in a rearward drive configuration of the marine propeller combination.

Optionally in some examples, including in at least one preferred example, the number of propeller blades of the first propeller is three and the number of propeller blades of the second propeller is four.

Optionally in some examples, including in at least one preferred example, the number of propeller blades of the first propeller is four and the number of propeller blades of the second propeller is four, and the first and second propellers are angularly positioned such that when two of the blades of the first or second propeller are vertically positioned, two of the blades of the other propeller are positioned angularly offset by 30 to 60 degrees with respect to the vertical.

Optionally in some examples, including in at least one preferred example, the first propeller is adapted to be mounted on a first shaft of the marine propulsion unit and the second propeller is adapted to be mounted on a second shaft of the marine propulsion unit, the first propeller comprises a first propeller position feature for angularly mounting the first propeller on the first shaft, and the second propeller comprises a second propeller position feature for angularly mounting the second propeller on the second shaft. A technical benefit may include that the mounting is facilitated, or that mounting in a favourable position is ensured.

Optionally in some examples, including in at least one preferred example, the first propeller position feature is a visual marking or shape irregularity and the second propeller position feature is a visual marking or shape irregularity.

Optionally in some examples, including in at least one preferred example, the first propeller position feature is a shape irregularity in an internal spline pattern of the first propeller and/or the second propeller position feature is a shape irregularity in an internal spline pattern of the second propeller. A technical benefit may include that mounting in a favourable position is ensured.

According to a second aspect of the disclosure, there is provided a marine propulsion unit comprising the above-described marine propeller combination and a drive leg supporting the marine propeller combination.

Optionally in some examples, including in at least one preferred example, the marine propulsion unit comprises a first shaft for the first propeller and a second shaft for the second propeller.

Optionally in some examples, including in at least one preferred example, the first shaft and the second shaft are arranged to rotate simultaneously in opposite directions at the same speed.

According to a third aspect of the disclosure, there is provided a marine propulsion unit for the above-described marine propeller combination, the marine propulsion unit comprising a drive leg and a first shaft for the first propeller and a second shaft for the second propeller.

Optionally in some examples, including in at least one preferred example, the first shaft comprises a first shaft position feature and the first propeller comprises a first propeller position feature, said features being provided for angularly mounting the first propeller on the first shaft, and the second shaft comprises a second position feature and the second propeller comprises a second propeller position feature, said features being provided for angularly mounting the second propeller on the second shaft.

According to a third aspect of the disclosure, there is provided a marine vessel comprising the above-described marine propeller combination or the above-described marine propulsion units, According to a fourth aspect of the disclosure, there is provided a method of operating a marine propeller combination for a marine propulsion unit comprising a drive leg supporting the marine propeller combination, the marine propeller combination comprising a first propeller and a second propeller arranged to rotate simultaneously in opposite directions about a common rotational axis, the method comprising angularly positioning the first propeller and the second propeller such that during one revolution one of the blades of the first propeller is aligned with the drive leg while a blade gap of the second propeller is aligned with the drive leg, or one of the blades of the first propeller is aligned with the drive leg while one of the blades of the second propeller is aligned with the drive leg.

According to a fourth aspect of the disclosure, there is provided a marine propeller comprising a number of propeller blades and an internal spline pattern, wherein the internal spline pattern comprises a shape irregularity for angularly positioning the marine propeller. The shape irregularity may be angularly aligned with respect to the propeller blades and may be a lacking spline, or a filled spline, in the internal spline pattern.

The benefits, and further possible features, of the second to fourth aspects correspond to those of the first aspect.

The disclosed aspects, examples (including any preferred examples), and/or accompanying claims may be suitably combined with each other as would be apparent to anyone of ordinary skill in the art. Additional features and advantages are disclosed in the following description, claims, and drawings, and in part will be readily apparent therefrom to those skilled in the art or recognized by practicing the disclosure as described herein.

BRIEF DESCRIPTION OF THE DRAWINGS

Examples are described in more detail below with reference to the appended drawings.

DETAILED DESCRIPTION

The detailed description set forth below provides information and examples of the disclosed technology with sufficient detail to enable those skilled in the art to practice the disclosure.

The inventive concept of the present disclosure is based on the realisation that in forward drive (pulling) counter-rotating propellers, a first or front propeller faces a uniform flow whereas the rear propeller faces a non-uniform flow. Further, the counter-rotating propellers create a downstream propeller wash that is dependent on the angular position between the front and rear propellers. The propeller wash impacts a drive leg, and the angular positioning between the front and rear propeller may according to the inventive concept be set to reduce the appendage drag.

In a rearward drive (pushing) counter-rotating propellers, the propellers face a wake generated by the drive leg, i.e. a non-uniform flow. The wake may create a fluctuation in the thrust and torque of the propellers, and the angular positioning between the front and rear propeller may, according to the inventive concept, be set to reduce torque and thrust fluctuations.

The inventive concept involves angularly positioning counter-rotating propellers with respect to a drive leg to optimise propulsion performance. The optimisation may involve reduced vibrations and/or increased efficiency.

Figure 1:
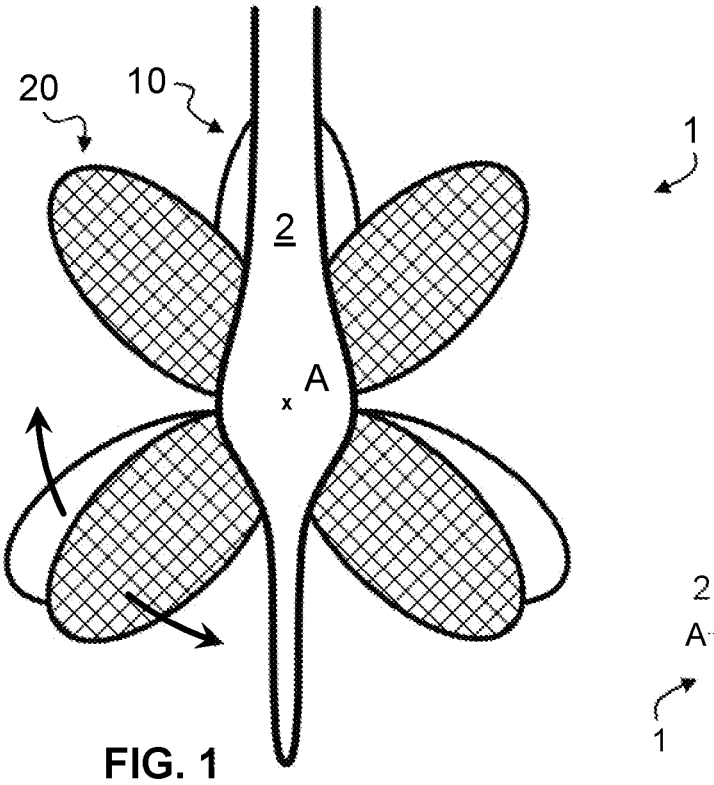
FIG. 1 is a stern view of an exemplary forward drive marine propeller combination comprising a first and a second propeller.
Figure 2:
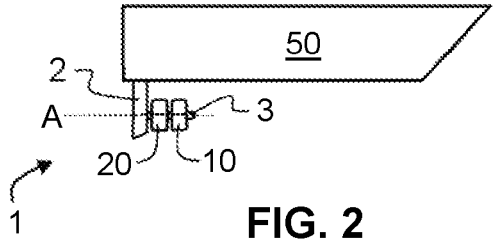
FIG. 2 is a side view of the forward drive marine propeller combination of FIG. 1 mounted on a marine vessel.
Figure 3:
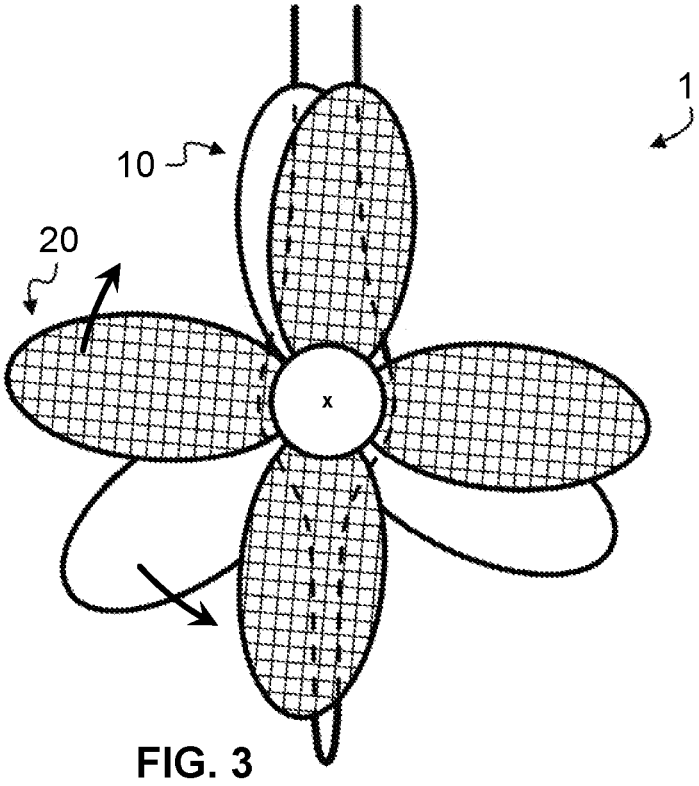
FIG. 3 is a stern view of an exemplary rearward drive marine propeller combination.
Figure 4:
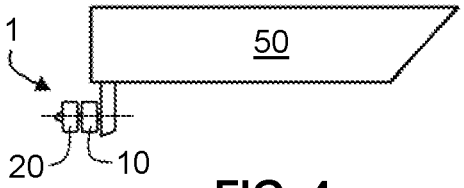
FIG. 4 is a side view of the rearward drive marine propeller combination of FIG. 3 mounted on a marine vessel.

FIGS. 1 to 4 illustrate a marine propeller combination and a marine propulsion unit 1. FIGS. 2 and 4 also illustrate a marine vessel 50.

The marine propeller combination comprises a first propeller 10 and a second propeller 20 arranged to rotate simultaneously in opposite directions about a common rotational axis A. The marine propulsion unit may be referred to as a coaxial counter-rotating (or contra-rotating) marine propulsion system.

Figure 5:
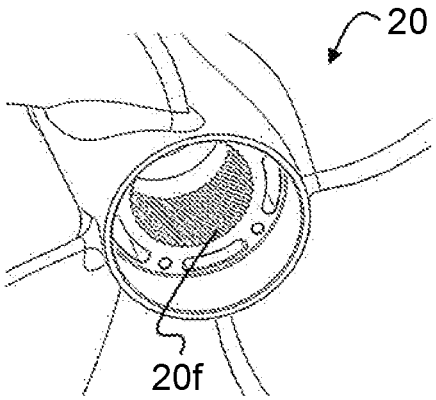
FIG. 5 shows an exemplary second propeller that may form part of the propeller combination of FIG. 1.
Figure 6:
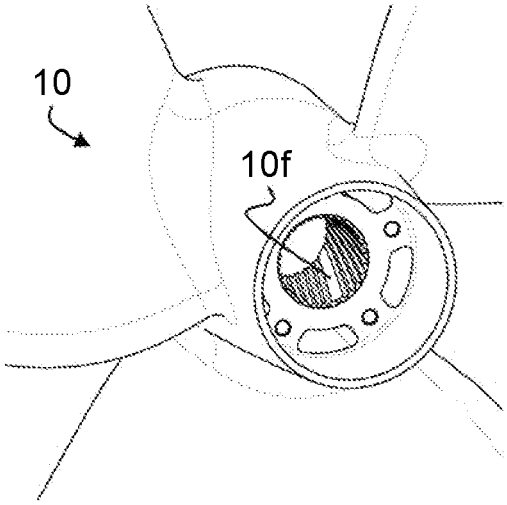
FIG. 6 shows an exemplary first propeller that may form part of the propeller combination of FIG. 1.

FIGS. 5 and 6 illustrate marine propellers 10, 20 each comprising a number of propeller blades and an internal spline pattern, wherein the internal spline pattern comprises a shape irregularity 10*f*, 20*f* for angularly positioning the marine propeller 10, 20.

Referring in particular to FIG. 1, the marine propeller combination is configured such that the first and second propellers 10, 20 are angularly positioned such that during one revolution, one of the blades of the first propeller 10 is aligned with a drive leg 2 of the marine propulsion unit 1 when a blade gap of the second propeller 20 is aligned with the drive leg 2. In other words, when one of the blades of the first propeller 10 is aligned with the drive leg 2, no propeller blade of the second propeller 20 is aligned with the drive leg 2. As is shown, this angular positioning is adapted for a forward drive configuration of the marine propeller combination, i.e. where the marine propeller combination is positioned on the bow side of the drive leg 2. A forward drive configuration may be referred to as a pulling configuration.

Alternatively, referring in particular to FIG. 3, the marine propeller combination is configured such that one of the blades of the first propeller 10 is aligned with the drive leg 2 when one of the blades of the second propeller 20 is aligned with the drive leg 2. As is shown, this angular positioning is adapted for a rearward drive configuration of the marine propeller combination, i.e. where the marine propeller combination is positioned on the stern side of the drive leg 2. A rearward drive configuration may be referred to as a pushing configuration.

Thus, in both cases the angular positions of the first and second propellers 10, 20 are deliberately selected in relation to the drive leg 2 of the marine propulsion unit 1. The blades of the propellers are deliberately set to either pass the drive leg 2 concurrently or to not pass the drive leg concurrently. In a rearward drive configuration, the blades of the propellers are set to pass the drive leg concurrently. In a forward drive configuration, the blades of the propellers are set to not pass the drive leg concurrently.

In other words, depending on whether the marine propeller combination is in a rearward or forwards drive configuration, the blades of the first propeller 10 and second propeller 20 are arranged to pass the drive leg 2 simultaneously, or are arranged to pass the drive leg 2 separately.

In some more detail, FIGS. 1 and 2 disclose a first or front propeller 10 and a second or rear propeller 20. The first propeller 10 is located on the bow side of the second propeller 20. In other words, the first propeller 10 is located in front of the second propeller 20 when the propellers 10, 20 travel through the water. The first propeller may rotate clockwise and the second propeller may rotate counter-clockwise, as is indicated by the curved arrows is FIG. 1.

Now, FIG. 1 shows the first propeller 10 angularly positioned such that one blade is aligned with, i.e. is positioned essentially straight in front of, the drive leg 2. To be precise, said blade is aligned with the portion of the drive leg 2 that is located between the propellers 10, 20 and the vessel 50, i.e. the portion above the propellers 10, 20.

In the disclosed example, the drive leg 2 also comprises a portion that is located on the distal side of the propellers 10, 20, i.e. below the propellers. As is shown, the portion of the drive leg 2 that is located between the propellers 10, 20 and the vessel 50 is substantially wider than the portion of the drive leg 2 that is located on the distal side of the propellers 10, 20. The latter portion is optional.

As is to be apprehended, the present disclosure relates to positioning the propellers with respect to the portion of the drive leg that is located between the propellers 10, 20 and the vessel.

Typically, when the first propeller 10 is angularly positioned such that one blade is aligned with the chi.ve leg 2, said blade is vertically positioned, or is oriented vertically, or is vertical, as is illustrated in FIG. 1. Typically, said blade points essentially straight upwards.

As is further shown in FIG. 1, a blade gap of the second propeller 20 is aligned with the drive leg 2. In other words, no propeller blade of the second propeller is aligned with the drive leg 2.

As is shown, the angular positioning of FIGS. 1 and 2 is adapted for a forward drive (pulling) configuration of the marine propeller combination, i.e. where the marine propeller combination is positioned on the bow side of the drive leg 2. Thus, as is illustrated, one of the blades of the first propeller 10 may be aligned with the drive leg 2 when a blade gap of the second propeller 20 is aligned with the drive leg 2 in a forward drive configuration of the marine propeller combination.

It is to be apprehended that the phrase "aligned with" does not mean that there needs to be a perfect alignment between for example a blade of the first propeller 10 and the drive leg 2. In FIG. 1, one blade of the first propeller 10 is oriented vertically and is exactly parallel to the drive leg 2. At the same time, the blades of the second propeller 20 that form the blade gap are exactly symmetrically positioned with respect to the drive leg 2. However, the inventive concept of the present disclosure does not prescribe any perfect alignment. It is believed that deviations of up to 1 degree, 2 degrees or up to 5 degrees may be acceptable.

Turning now to FIGS. 3 and 4, one of the blades of the first propeller 10 may be aligned with the drive leg 2 when one of the blades of the second propeller 20 is aligned with the drive leg 2 in a rearward drive configuration of the marine propeller combination. In the present example, one of the blades of both propellers point essentially straight upwards.

In undepicted embodiments, the first propeller 10 and the second propeller 20 may have the same number of blades. The first propeller 10 may have two to six blades and the second propeller 20 may have two to six blades.

In the illustrated examples, the first propeller 10 and the second propeller 20 do not have the same number of propeller blades.

As is shown in FIGS. 1 and 3 (and in FIGS. 5 and 6), in the present examples the number of propeller blades of the first propeller 10 is three and the number of propeller blades of the second propeller 20 is four.

Referring again to FIG. 1 and envisioning that the first propeller 10 from the shown orientation has rotated 45 degrees clockwise and the second propeller has rotated 45 degrees counter-clockwise. The positioning may be such that the second propeller 20 may be angularly positioned with two of the blades being vertical and the other two being horizontal while the blades of the second propeller 10 are positioned offset by 30 to 60 degrees with respect to the vertical.

In an undisclosed example, the number of propeller blades of the first propeller 10 is four and the number of propeller blades of the second propeller 20 is four. In a forward drive configuration, the first and second propellers 10, 20 may then be angularly positioned such that when two of the blades of the first or second propeller 10, 20 are vertically oriented, two of the blades of the other propeller 10, 20 are positioned angularly offset by 30 to 60 degrees with respect to the vertical. Thereby, the blades of the propellers 10, 20 are set to not pass a drive leg concurrently, the drive leg extending vertically upwards from the propellers 10, 20. In a rearward drive configuration, the first and second propellers 10, 20 may instead not be angularly offset.

Figure 7:
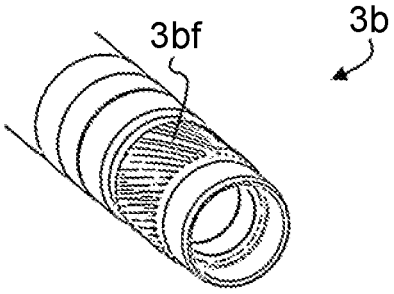
FIG. 7 shows an exemplary shaft for the second propeller of FIG. 5.
Figure 8:
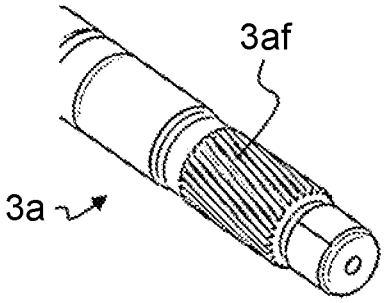
FIG. 8 shows an exemplary shaft for the first propeller of FIG. 6.

FIGS. 7 and 8 show the distal ends of a first shaft 3*a* and a second shaft 3*b* of the marine propulsion unit 1, the shafts 3*a*, 3*b* being jointly denoted with the reference number 3 in FIG. 2. Referring to FIGS. 1, 2 and 5 to 8, the first propeller 10 (FIG. 6) may be adapted to be mounted on the first shaft 3*a* (FIG. 8) of the marine propulsion unit 1. The first shaft 3*a* may be referred to as a front shaft or an inner shaft. The second propeller 20 may be adapted to be mounted on the second shaft 3*b* of the marine propulsion unit 1. The second shaft 3*b* may be referred to as a rear shaft or an outer shaft.

As is exemplarily shown in FIG. 6, the first propeller 10 may comprise a first propeller position feature 10*f* for angularly mounting the first propeller 10 on the first shaft 3*a*. The first propeller position feature 10*f* may be a visual marking or, as illustrated herein, a shape irregularity on the first propeller 10. The visual marking may be a painted mark or a sticker.

In the present example, the first propeller position feature 10*f* is a shape irregularity in an internal spline pattern of the first propeller 10. More precisely, as is shown in FIG. 6, one spline is filled. Alternatively, in undepicted examples one spline may be lacking.

The spline pattern may be said to comprise a number of circumferential teeth. A filled spline, as is shown in FIG. 6, corresponds to a filled gap between two neighbouring teeth. A lacking spline corresponds to one lacking tooth.

The spline patterns disclosed herein extend at an angle to the longitudinal propeller axes. The spline patterns are thus helical. In undepicted examples, the spline patterns may be straight, i.e. extend parallel to longitudinal propeller axes.

As is exemplarily shown in FIG. 5, the second propeller 20 may comprise a second propeller position feature 20*f* for angularly mounting the second propeller 20 on the second shaft 3*b*. The second propeller position feature 20*f* may be a visual marking or, as illustrated herein, a shape irregularity on the second propeller 20.

The present second propeller position feature 20*f* is a shape irregularity in the internal spline pattern of the second propeller 20, more precisely a filled spline. In undepicted examples, one spline may instead be lacking.

As is apprehended from FIGS. 5 to 8, the second propeller 20 may comprise a second propeller position feature 20*f* for angularly mounting the second propeller 20 on the second shaft 3*b*. In other words, by means of the second propeller position feature 20*f*, the second propeller 20 may more easily be positioned at a desired rotational angle with respect to the second shaft 3*b*. This may alternatively be expressed as the second propeller position feature 20*f* facilitating setting the desired angle of the propeller blades with respect to the second shaft 3*b*.

In the present examples, the first propeller position feature 10*f* is adapted for a first shaft position feature 3*af* and the second propeller position feature 20*f* is adapted for a second shaft position feature 3*bf*. Referring to FIGS. 6 and 8, the first shaft position feature 3*af* is a lacking external spline and the first propeller position feature 10*f* is a filled internal spline. As has been described, the reverse situation is also possible. Such a solution may avoid, or even make impossible, that the propeller is incorrectly rotationally positioned on the shaft.

As is to be apprehended, one or both propellers 10, 20 or shafts 3*a*, 3*b* may comprise regular uniform spline patterns and the deliberate positioning of the propellers 10, 20 with respect to the shafts 3*a*, 3*b* may be obtained by a skilled operator or through use of instructions that provide accurate guidance.

In order to facilitate, or ensure, that one or both shafts 3*a*, 3*b* are correctly angularly oriented with regards to a drive, such as gears, at the proximal (not shown in detail) ends of one or both shafts 3*a*, 3*b*, one or both shafts may comprise undepicted shaft gear position features. Such shaft gear position features may facilitate, or ensure, that a shaft is correctly angularly oriented with regards to the drive.

The first shaft 3*a* and the second shaft 3*b* may be arranged to rotate simultaneously in opposite directions at the same speed, or rpm. Thus, also the propellers 10, 20 may be arranged to rotate simultaneously in opposite directions at the same speed. For example, the shafts 3*a*, 3*b* may both be driven by one and the same bevel gear. However, the disclosure does not exclude that the first and second shafts 3*a*, 3*b* may be arranged to rotate simultaneously in opposite directions at different speeds. For example, the first shaft 3*a* (and the first propeller 10) may be arranged to rotate independently from the second shaft 3*b* (and second propeller 20). The inventive concept may in the latter case be utilised in situations when the shafts 3*a*, 3*b* are driven to rotate simultaneously in opposite directions at the same speed. In such a case, there may be provided sensors or other means for registering the angular positions of the shafts 3*a*, 3*b* and/or the propellers 10, 20.

Figure 9:
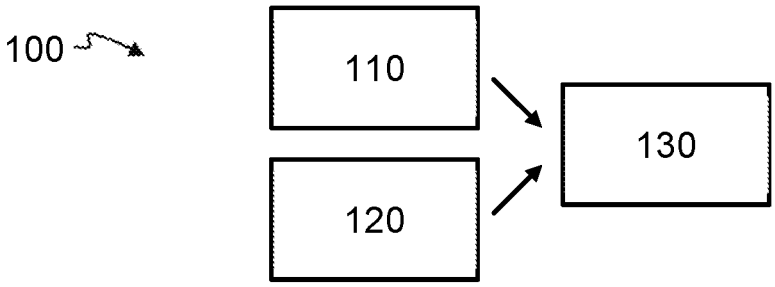
FIG. 9 illustrates a method of operating a marine propeller combination.

FIG. 9 illustrates a method 100 of operating a marine propeller combination for a marine propulsion unit 1 comprising a drive leg 2 supporting the marine propeller combination. The marine propeller combination may be of the type described herein. Thus, the marine propeller combination may comprise a first propeller 10 and a second propeller 20 arranged to rotate simultaneously in opposite directions about a common rotational axis A, the method 100 comprising angularly positioning 130 the first propeller 10 and the second propeller 20 such that during one revolution one of the blades of the first propeller 10 is aligned with the drive leg 2 while a blade gap of the second propeller 20 is aligned with the drive leg 2, or one of the blades of the first propeller 10 is aligned with the drive leg 2 while one of the blades of the second propeller 20 is aligned with the drive leg 2.

The method 100 may comprise rotating 110 the first propeller 10 and the second propeller 20 at the same speed, or sensing 120 the position of the first propeller 10 and the second propeller 20 in relation to the drive leg 2.

Also disclosed are examples according to the following clauses:

1. A marine propeller combination for a marine propulsion unit (1), the marine propeller combination comprising a first propeller (10) and a second propeller (20) arranged to rotate simultaneously in opposite directions about a common rotational axis (A), wherein the marine propeller combination is configured such that the first and second propellers (10, 20) are angularly positioned such that during one revolution
   - one of the blades of the first propeller (10) is aligned with a drive leg (2) of the marine propulsion unit (1) when a blade gap of the second propeller (20) is aligned with the drive leg (2), or
   - one of the blades of the first propeller (10) is aligned with the drive leg (2) when one of the blades of the second propeller (20) is aligned with the drive leg (2).

2. The marine propeller combination of clause 1, wherein one of the blades of the first propeller (10) is aligned with the drive leg (2) when a blade gap of the second propeller (20) is aligned with the drive leg (2) in a forward drive configuration of the marine propeller combination.

3. The marine propeller combination of clause 1 or 2, wherein one of the blades of the first propeller (10) is aligned with the drive leg (2) when one of the blades of the second propeller (20) is aligned with the drive leg (2) in a rearward drive configuration of the marine propeller combination.

4. The marine propeller combination of any preceding clause, wherein the first propeller (10) and the second propeller (20) have the same number of blades.

5. The marine propeller combination according to any of clauses 1 to 3, wherein the first propeller (10) and the second propeller (20) do not have the same number of propeller blades.

6. The marine propeller combination of any preceding clause, wherein the number of propeller blades of the first propeller (10) is three and the number of propeller blades of the second propeller (20) is four.

7. The marine propeller combination according to any of clauses 1 to 5, wherein the number of propeller blades of the first propeller (10) is four and the number of propeller blades of the second propeller (20) is four, and the first and second propellers (10, 20) are angularly positioned such that when two of the blades of the first or second propeller (10, 20) are vertically oriented, the blades of the other propeller (10, 20) are positioned angularly offset by 30 to 60 degrees with respect to the vertical.

8. The marine propeller combination of any preceding clause, wherein the first propeller (10) has two to six blades and the second propeller (20) has two to six blades.

9. The marine propeller combination of any preceding clause, wherein
   - the first propeller (10) is adapted to be mounted on a first shaft (3*a*) of the marine propulsion unit (1) and the second propeller (20) is adapted to be mounted on a second shaft (3*b*) of the marine propulsion unit (1),
   - the first propeller (10) comprises a first propeller position feature (10*f*) for angularly mounting the first propeller (10) on the first shaft (3*a*), and
   - the second propeller (20) comprises a second propeller position feature (20*f*) for angularly mounting the second propeller (20) on the second shaft (3*b*).

10. The marine propeller combination of clause 9, wherein the first propeller position feature (10*f*) is a visual marking or shape irregularity and the second propeller position feature (20*f*) is a visual marking or shape irregularity.

11. The marine propeller combination of clause 9 or 10, wherein the first propeller position feature (10*f*) is a shape irregularity in an internal spline pattern of the first propeller (10) and/or the second propeller position feature (20*f*) is a shape irregularity in an internal spline pattern of the second propeller (20).

12. The marine propeller combination according to any of clauses 9 to 11, wherein the first propeller position feature (10*f*) is adapted for a first shaft position feature (3*af*) and the second propeller position feature (20*f*) is adapted for a second shaft position feature (3*bf*).

13. A marine propulsion unit (1) comprising the marine propeller combination of any preceding clause and a drive leg (2) supporting the marine propeller combination.

14. The marine propulsion unit (1) of clause 13, comprising a first shaft (3*a*) for the first propeller (10) and a second shaft (3*b*) for the second propeller (20).

15. The marine propulsion unit (1) of clause 14, wherein the first propeller (10) comprises a first propeller position feature (10*f*) and the first shaft (3*a*) comprises a first shaft position feature (3*af*), said features (10*f*, 3*af*) being provided for angularly mounting the first propeller (10) on the first shaft (3*a*), and the second propeller (20) comprises a second propeller position feature (20*f*) and the second shaft (3*b*) comprises a second position feature (3*bf*), said features (20*f*, 3*bf*) being provided for angularly mounting the second propeller (20) on the second shaft (3*b*).

16. The marine propulsion unit (1) of clause 15, wherein the first propeller position feature (10*f*) is a shape irregularity in an internal spline pattern of the first propeller (10) and the first shaft position feature (3*af*) is a shape irregularity in an external spline pattern of the first shaft (3*a*), and/or the second propeller position feature (20*f*) is a shape irregularity in an internal spline pattern of the second propeller (20) and the second shaft position feature (3*bf*) is a shape irregularity in an external spline pattern of the second shaft (3*b*).

17. The marine propulsion unit (1) of clause 16, wherein the shape irregularity in the external spline pattern of the first shaft (3*a*) comprises a filled spline, and/or the shape irregularity in the external spline pattern of the second shaft (3*b*) comprises a filled spline.

18. The marine propulsion unit (1) according to any of clauses to 15 to 17, wherein the first shaft (3*a*) comprises a shaft gear position feature for angularly connecting the first shaft (3*a*) to a gear that is adapted to drive the first shaft (3*a*), and the second shaft (3*b*) comprises a shaft gear position feature for angularly connecting the second shaft (3*b*) to a gear that is adapted to drive the second shaft (3*b*).

19. The marine propulsion unit (1) according to any of clauses to 13 to 18, wherein the first shaft (3*a*) and the second shaft (3*b*) are arranged to rotate simultaneously in opposite directions at the same speed.

20. A marine propulsion unit (1) for the marine propeller combination according to any of clauses 1 to 12, the marine propulsion unit (1) comprising a drive leg (2) and a first shaft (3*a*) for the first propeller (10) and a second shaft (3*b*) for the second propeller (20).

21. The marine propulsion unit (1) of clause 20, wherein the first shaft (3*a*) comprises a first shaft position feature (3*af*) and the first propeller (10) comprises a first propeller position feature (10*f*), said features (10*f*, 3*af*) being provided for angularly mounting the first propeller (10) on the first shaft (3*a*), and the second shaft (3*b*) comprises a second position feature (3*bf*) and the second propeller (20) comprises a second propeller position feature (20*f*), said features (20*f*, 3*bf*) being provided for angularly mounting the second propeller (20) on the second shaft (3*b*).

22. The marine propulsion unit (1) of clause 21, wherein the first shaft position feature (3*af*) is a shape irregularity in an external spline pattern of the first shaft (3*a*) and the first propeller position feature (10*f*) is a shape irregularity in an internal spline pattern of the first propeller (10), and/or the second shaft position feature (3*bf*) is a shape irregularity in an external spline pattern of the second shaft (3*b*) and the second propeller position feature (20*f*) is a shape irregularity in an internal spline pattern of the second propeller (20).

23. The marine propulsion unit (1) according to any of clauses to 20 to 22, wherein the first shaft (3*a*) and the second shaft (3*b*) are arranged to rotate simultaneously in opposite directions at the same speed.

24. A marine vessel (50) comprising the marine propeller combination according to any of clauses 1 to 12 or the marine propulsion unit according to any of clauses 13 to 19 or the marine propulsion unit according to any of clauses 19 to 23.

25. A method (100) of operating a marine propeller combination for a marine propulsion unit (1) comprising a drive leg (2) supporting the marine propeller combination, the marine propeller combination comprising a first propeller (10) and a second propeller (20) arranged to rotate simultaneously in opposite directions about a common rotational axis (A), the method (100) comprising angularly positioning (130) the first propeller (10) and the second propeller (20) such that during one revolution one of the blades of the first propeller (10) is aligned with the drive leg (2) while a blade gap of the second propeller (20) is aligned with the drive leg (2), or one of the blades of the first propeller (10) is aligned with the drive leg (2) while one of the blades of the second propeller (20) is aligned with the drive leg (2).

26. The method (100) of clause 25, comprising rotating (110) the first propeller (10) and the second propeller (20) at the same speed, or sensing (120) the position of the first propeller (10) and the second propeller (20) in relation to the drive leg (2).

27. A marine propeller (10, 20) comprising a number of propeller blades and an internal spline pattern, wherein the internal spline pattern comprises a shape irregularity (10*f*, 20*f*) for angularly positioning the marine propeller (10, 20).

28. The marine propeller (10, 20) of clause 27, wherein the shape irregularity (10*f*, 20*f*) is angularly aligned with respect to the propeller blades.

29. The marine propeller (10, 20) of clause 27 or 28, wherein the shape irregularity (10*f*, 20*f*) is a lacking spline or a filled spline in the internal spline pattern.

30. The marine propeller (10, 20) according to any of clauses 27 to 27, wherein the marine propeller (10, 20) is configured to be mounted on a shaft (3*a*, 3*b*) having an external spline pattern that comprises a shape irregularity (3*af*, 3*bf*), and wherein the shape irregularity (10*f*, 20*f*) of the marine propeller (10, 20) fits the shape irregularity (3*af*, 3*bf*) of the shaft (3*a*, 3*b*).

Herein, the drive leg 2 may support, in other words hold, the marine propeller combination. The drive leg 2 may support the propellers 10, 20. The drive leg may provide power to the propellers 10, 20. There may for example be an undepicted drive shaft extending within the drive leg 2. Typically, the drive leg 2 extends from a vessel 50 to the propellers 10, 20, as disclosed in FIGS. 2 and 4. The drive leg 2 may extend from a main part of a propulsion unit 1 to the propellers 10, 20. The main part may be configured to be attached to a transom of a marine vessel. The main part may comprise a propulsion motor, such as a combustion engine or an electric propulsion motor, which drives the propellers 10, 20. Typically, the drive leg 2, or the portion of the drive leg 2, that is referred to herein is during operation located between the propellers and the water surface. In other words, the drive leg 2, or the portion of the drive leg 2, that is referred to in herein is located above the propellers 10, 20 during operation.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, actions, steps, operations, elements, and/or components, but do not preclude the presence or addition of one or more other features, integers, actions, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the disclosure being set forth in the following claims.

The invention claimed is:

1. A marine propeller combination, the marine propeller combination comprising a first propeller and a second propeller arranged to rotate simultaneously in opposite directions about a common rotational axis, the first propeller is adapted to be mounted on a first shaft of the marine propulsion combination and the second propeller is adapted to be mounted on a second shaft of the marine propulsion combination, the first propeller comprises a first propeller position feature for angularly mounting the first propeller on the first shaft, the second propeller comprises a second propeller position feature for angularly mounting the second propeller on the second shaft, and the first propeller position feature is a visual marking or shape irregularity and the second propeller position feature is a visual marking or shape irregularity, wherein the first propeller position feature and the second propeller position features are arranged on the first and second propellers such that the first and second propellers are angularly positioned on the first and second shaft, respectively, such that during one revolution one of a plurality of blades of the first propeller is aligned with a drive leg of a marine propulsion unit when a blade gap of the second propeller is aligned with the drive leg, or one of the plurality of blades of the first propeller is aligned with the drive leg when one of a plurality of blades of the second propeller is aligned with the drive leg.

2. The marine propeller combination of claim 1, wherein one of the blades of the first propeller is aligned with the drive leg when the blade gap of the second propeller is aligned with the drive leg in a forward drive configuration of the marine propeller combination.

3. The marine propeller combination of claim 1, wherein one of the blades of the first propeller is aligned with the drive leg when one of the blades of the second propeller is aligned with the drive leg in a rearward drive configuration of the marine propeller combination.

4. The marine propeller combination of claim 1, wherein a number of propeller blades of the first propeller is three and a number of propeller blades of the second propeller is four.

5. The marine propeller combination according to claim 1, wherein a number of propeller blades of the first propeller is four and a number of propeller blades of the second propeller is four, and the first and second propellers are angularly positioned such that when two of the blades of the first or second propeller are vertically oriented, two of the blades of the other propeller are positioned angularly offset by 30 to 60 degrees with respect to a vertical axis.

6. The marine propeller combination of claim 1, wherein the first propeller position feature is the shape irregularity in an internal spline pattern of the first propeller and/or the second propeller position feature is the shape irregularity in an internal spline pattern of the second propeller.

7. The marine propeller combination according to claim 1, wherein the first propeller position feature is adapted for a first shaft position feature and the second propeller position feature is adapted for a second shaft position feature.

8. A marine vessel comprising the marine propeller combination according to claim 1.

9. The marine propeller combination of claim 1, wherein the shape irregularity is a lacking spline or a filled spline in an internal spline pattern.

10. The marine propeller combination according to claim 1, wherein the first propeller position feature is the shape irregularity in an internal spline pattern of the first propeller and a corresponding first shaft position feature is a shape irregularity in an external spline pattern of the first shaft, and/or the second propeller position feature is the shape irregularity in an internal spline pattern of the second propeller and a corresponding second shaft position feature is a shape irregularity in an external spline pattern of the second shaft.

11. A marine propulsion unit, comprising:

a marine propeller combination and a drive leg supporting the marine propeller combination, wherein the marine propeller combination comprises a first propeller and a second propeller arranged to rotate simultaneously in opposite directions about a common rotational axis, the first propeller is adapted to be mounted on a first shaft of the marine propulsion unit and the second propeller is adapted to be mounted on a second shaft of the marine propulsion unit, the first propeller comprises a first propeller position feature for angularly mounting the first propeller on the first shaft, the second propeller comprises a second propeller position feature for angularly mounting the second propeller on the second shaft, and the first propeller position feature is a visual marking or shape irregularity and the second propeller position feature is a visual marking or shape irregularity, wherein the first propeller position feature and the second propeller position features are arranged on the first and second propellers such that the first and second propellers are angularly positioned on the first and second shaft, respectively such that during one revolution:

one of a plurality of blades of the first propeller is aligned with a drive leg of a marine propulsion unit when a blade gap of the second propeller is aligned with the drive leg, or one of the plurality of blades of the first propeller is aligned with the drive leg when one of a plurality of blades of the second propeller is aligned with the drive leg.

12. The marine propulsion unit of claim 11, wherein the first propeller comprises the first propeller position feature and the first shaft comprises a corresponding first shaft position feature, said features being provided for angularly mounting the first propeller on the first shaft, and the second propeller comprises the second propeller position feature and the second shaft comprises a corresponding second position feature, said features being provided for angularly mounting the second propeller on the second shaft.

13. The marine propulsion unit of claim 12, wherein the first propeller position feature is the shape irregularity in an internal spline pattern of the first propeller and the first shaft position feature is a shape irregularity in an external spline pattern of the first shaft, and/or the second propeller position feature is the shape irregularity in an internal spline pattern of the second propeller and the second shaft position feature is a shape irregularity in an external spline pattern of the second shaft.

14. The marine propulsion unit of claim 13, wherein the shape irregularity in the external spline pattern of the first shaft comprises a filled spline, and/or the shape irregularity in the external spline pattern of the second shaft comprises a filled spline.

15. The marine propulsion unit according to claim 11, wherein the first shaft and the second shaft are arranged to rotate simultaneously in opposite directions at the same speed.

16. A marine propulsion unit according to claim 11, the marine propulsion unit comprising the drive leg and the first shaft for the first propeller and the second shaft for the second propeller.

17. The marine propulsion unit of claim 16, wherein the first shaft comprises a first shaft position feature corresponding to the first propeller position feature, said features being provided for angularly mounting the first propeller on the first shaft, and the second shaft comprises a second position feature corresponding to the second propeller position feature, said features being provided for angularly mounting the second propeller on the second shaft.

* * * * *